US005477242A

United States Patent [19]

Thompson et al.

[11] Patent Number: 5,477,242

[45] Date of Patent: Dec. 19, 1995

[54] DISPLAY ADAPTER FOR VIRTUAL VGA SUPPORT IN XGA NATIVE MODE

[75] Inventors: Stephen P. Thompson, Delray Beach; Darwin P. Rackley; Sherwood Brannon, both of Boca Raton, all of Fla.

[73] Assignee: International Business Machines Corporation, Armonk, N.Y.

[21] Appl. No.: 177,105

[22] Filed: Jan. 3, 1994

[51] Int. Cl.[6] ..... G09G 5/00

[52] U.S. Cl. ..... 345/132; 345/203

[58] Field of Search ..... 345/118, 119, 345/120, 132, 203, 275

[56] References Cited

U.S. PATENT DOCUMENTS

| | | | |
|---|---|---|---|
| 4,533,910 | 8/1985 | Sukonick | 345/118 |
| 4,651,146 | 3/1987 | Lucash | 345/119 |
| 4,653,020 | 3/1987 | Cheselka | 345/119 |
| 4,823,108 | 4/1989 | Pope | 345/120 |
| 4,918,436 | 4/1990 | Johary | 345/132 |
| 4,980,765 | 12/1990 | Kudo | 345/203 |
| 4,990,904 | 2/1991 | Zenda . | |
| 5,047,958 | 9/1991 | Comins | 345/203 |
| 5,062,057 | 10/1991 | Blacken | 345/203 |
| 5,113,180 | 5/1992 | Gupta | 345/203 |
| 5,189,401 | 2/1993 | Kugler, Jr. et al. | 345/132 |
| 5,231,383 | 7/1993 | Diepstraten | 345/203 |
| 5,291,188 | 3/1994 | McIntyre | 345/203 |
| 5,379,052 | 1/1995 | Walck | 345/132 |
| 5,396,597 | 3/1995 | Bodin | 395/275 |

FOREIGN PATENT DOCUMENTS

| | | | |
|---|---|---|---|
| 0052755 | 6/1982 | European Pat. Off. | 345/203 |
| 0202166 | 11/1986 | European Pat. Off. | 345/119 |
| 8605910 | 10/1986 | WIPO | 345/118 |
| 9115841 | 10/1991 | WIPO | 345/132 |

OTHER PUBLICATIONS

PEGA2 User's Guide (50208 Rev. 4), 1986 pp. 2–62.

IBM Personal System/2 and Personal Computer BIOS Interface Technical Reference, 1987, pp. 19–126.

*Primary Examiner*—Richard Hjerpe
*Assistant Examiner*—Regina Liang
*Attorney, Agent, or Firm*—Martin J. McKinley; Haynes & Boone

[57] ABSTRACT

Method and apparatus for enabling an XGA display adapter selectively to support VGA graphics mode virtualization during native mode operation of the adapter by rendering VGA graphics assist hardware and certain VGA registers accessible. In a preferred embodiment, the invention comprises an XGA display adapter which includes a host interface for interfacing the display adapter with a central processing unit (CPU) of a personal computer (PC), VGA graphics assist hardware for performing VGA graphics assist functions, a memory controller for reading and writing a video memory of the PC as requested by the CPU during video memory accesses, and a display interface for generating control and timing signals to a display of the PC. The XGA display adapter also includes a XGA Operating Mode Register having three control bits which can be written by applications software selectively to enable or disable the virtual VGA function of the present invention. When the virtual VGA function is enabled, logic circuitry within the host interface examines the CPU address associated with each video memory access to determine whether the access comprises a virtual VGA memory access, rather than a native memory access. If so, the host interface routes CPU address and any data to be written to the video memory at that address, which performs the appropriate graphics assist operations on the address and/or data to enable the requested operation accurately to be performed on a virtual VGA memory buffer portion of the video memory by the memory controller.

21 Claims, 3 Drawing Sheets

SYSTEM MEMORY MAP
300

100000000h(64GB)
310
4MB APERTURE
1000000h(16MB)
308
1MB APERTURE
100000h(1MB)
306
C0000h
NATIVE APERTURE (XGA)
B0000h
VGA APERTURE
A0000h
304
128KB VGA MEMORY
302

400
406
402d
CPU ADDRESS

4MB APERTURE RANGE
REG
202d
402c
404
NATIVE MEMORY ACCESS
1MB APERTURE RANGE
REG
202c
64K "NATIVE" APERTURE RANGE
REG
202b
402b
VIRTUAL VGA MEMORY ACCESS
64K VGA APERTURE RANGE
REG
202a
402a

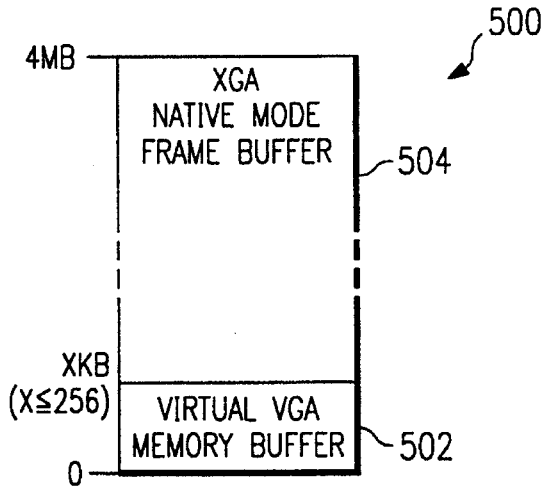

*FIG. 5*

| VGA REGISTER | BITS |
|---|---|
| MISCELLANEOUS OUTPUT REGISTER | 5 |
| SEQUENCER MAP MASK (INDEX 2) | 0–3 |
| SEQUENCER MEMORY MODE (INDEX 4) | 1–3 |
| CRTC UNDERLINE LOCATION (INDEX 14h) | 6 |
| CRTC MODE CONTROL (INDEX 17h) | 6 |
| GRAPHICS SET/RESET (INDEX 0) | 0–3 |
| GRAPHICS ENABLE SET/RESET (INDEX 1) | 0–3 |
| GRAPHICS COLOR COMPARE (INDEX 2) | 0–3 |
| GRAPHICS DATA ROTATE (INDEX 3) | 0–4 |
| GRAPHICS READ MAP SELECT (INDEX 4) | 0–1 |
| GRAPHICS MODE (INDEX 5) | 0–4 |
| GRAPHICS MISCELLANEOUS (INDEX 6) | 0–3 |
| GRAPHICS COLOR DON'T CARE (INDEX 7) | 0–3 |
| GRAPHICS BIT MASK (INDEX 8) | 0–7 |

*FIG. 6*

DISPLAY ADAPTER FOR VIRTUAL VGA SUPPORT IN XGA NATIVE MODE

TECHNICAL FIELD

The invention relates generally to display adapters for personal computers and, more specifically, to an XGA display adapter which supports VGA graphics modes in XGA native mode.

BACKGROUND OF THE INVENTION

In microprocessor-based computer systems, such as personal computers (PCs), display adapters are provided for interfacing video commands issued by the CPU with the PC's video display to control the operation thereof. One popular type of display adapter is the video graphics array, or VGA, manufactured by International Business Machines Corporation (IBM). Since its introduction in 1987, VGA has become so widely accepted that many software producers have developed applications programs which utilize VGA display modes (i.e., graphics and text modes) to produce the display output.

The growing popularity of operating system environments which provide windowing features, such as "Presentation Manager," developed by IBM, Armonk, N.Y., and "Microsoft Windows," developed by Microsoft Corporation, Redmond, Wash., has created problems with respect to VGA compatibility. In windowing environments, the video display screen may be divided into a plurality of display areas, or windows, in which different applications may be executed simultaneously. For example, a word processing application may be executed in a first window, while a spreadsheet application is executed in a second window. Although it is clearly desirable to provide users with the ability to execute VGA-based applications in windows, rather than full screen, computer hardware and software developers have discovered that such applications cannot be directly executed in windowing environments. Therefore, unless certain modifications are made to the PC's hardware or operating environment software, whenever a VGA-based application is to be executed, applications executing under the windowing environment must be suspended and the display screen must be blanked before the display output of the VGA-based application can be displayed.

Various techniques have been developed to overcome the above-described "VGA-in-a-window" problem. For VGA text modes, this has been accomplished by using software to map a VGA-based application's video buffer, which comprises a coded text buffer, to a virtual video buffer comprising a portion of video memory that is not being used to store data for display on the PC's display monitor. The application is then free to read from and write to its virtual video buffer at will. Periodically, a virtual device driver of the operating system will read the contents of the application's virtual video buffer and display it in the appropriate window on the display screen. Because coded text buffers are easily converted to text in a graphics mode, simulating, or "virtualizing," VGA text modes in the above manner is fairly straightforward and can be easily performed using only software.

Conversely, it would be extremely impractical, in terms of CPU overhead, to virtualize VGA graphics modes using only software. The main reason for this is that in VGA graphics modes, video memory is organized in a planar format in which video memory is divided into four separate bit planes with one bit of each four-bit pixel being stored on each of the planes. Typically, a CPU is able to access only one plane at a time; however, VGA adapters include certain graphics assist hardware that enables the CPU to simultaneously access all four :memory planes. As a result, in VGA graphics modes, whenever the CPU writes or reads one byte of data to or from video memory, four bytes of data, or,eight pixels, are actually affected. This same graphics assist hardware also performs other pixel data operations such as data rotate, color expansion, color compare and bit masking. The aforementioned operations performed by the graphics assist hardware to enable VGA to exploit the planar format of the video memory during video memory accesses are hereinafter referred to collectively as "VGA graphics assist functions."

Using software alone to simulate VGA graphics modes in a windowing environment would inhibit an application from reading from and writing to its virtual video buffer without invoking simulation software for each such access, as subsequent accesses to the virtual video buffer may be dependent upon data previously written thereto, but not yet processed by the simulation software. The CPU overhead involved in processing a virtual memory page fault and simulating the VGA graphics assist hardware for each access to the virtual video buffer makes any software-only method of virtualizing VGA graphics modes extremely slow and inefficient and therefore highly impractical.

Several graphics adapters, such as VGA, 8514/A and Image Adapter/A adapters, virtualize VGA graphics mode by utilizing actual VGA graphics assist hardware coupled with supervisory software. 16 KB blocks of off-screen video memory (corresponding to 4 KB blocks from the point of view of the CPU) are allocated to each application for use as a virtual video buffer and a virtual VGA device driver maps each application's video buffer to its virtual video buffer. VGA registers are loaded with values provided by the application, and the application is allowed freely to read and write VGA-style memory to and from its virtual video buffer, using the VGA graphics assist hardware to process each memory access. Periodically, the virtual device driver will render the virtual video buffer in the appropriate window on the display screen, In this manner, virtual memory page faults need only be processed if an application accesses video memory outside of its virtual video buffer. The use of actual VGA hardware to perform the graphics assist functions makes this VGA graphics mode virtualization technique practical.

More recently, IBM introduced a new display adapter standard, known as the extended graphics array, or XGA. XGA has two operating modes: a VGA mode and an "extended," or "native," mode. In its VGA mode, XGA is hardware compatible with a conventional VGA adapter and includes all VGA features and display modes. In its extended mode, it generates either 640 ×480 or 1024×768 pixel resolution in graphics modes, as designated by applications software. Additionally, native mode XGA employs a linear, or "packed pixel," video memory format, rather than the planar format used in VGA. Therefore, if a pixel is :represented by eight bits of data, one byte of data read from or written to video memory affects eight bits of a single pixel, rather than 32 bits of eight pixels, as is the case in VGA graphics modes.

Present XGA adapter designs enable operation in either VGA mode or XGA native mode, but not both simultaneously, which means that when an XGA adapter is operating in its native mode, VGA graphics assist hardware, which is used When XGA is in VGA mode, is rendered inaccessible and virtual VGA graphics modes are not supported. As a result, because the VGA hardware cannot be accessed during operation in XGA native mode and because, as previously indicated, it is impractical to virtualize VGA graphics modes using only software, current XGA adapters and device drivers do not support VGA graphics modes in a window.

Therefore, what is needed is an XGA display adapter which supports virtualization of VGA graphics modes during XGA native mode operation.

SUMMARY OF THE INVENTION

The foregoing problems are solved and a technical advance is achieved by method and apparatus for an XGA display adapter that selectively supports VGA graphics mode virtualization during native mode operation of the adapter. In a departure from the art, the XGA adapter of the present invention renders VGA graphics assist hardware and certain VGA registers accessible while the adapter is operating in XGA native mode to enable VGA-based applications to be executed in a window.

In a preferred embodiment, the present invention comprises an XGA display adapter, which includes a host interface for interfacing the display adapter with a central processing unit (CPU) of a personal computer (PC), VGA graphics assist hardware for performing VGA graphics assist functions such as data rotate, color expansion and others, a memory controller for reading data from and/or writing data to a video memory, or VRAM, as requested by the CPU during video memory accesses, and a display interface for generating horizontal and vertical synchronization timing signals and other control signals used for controlling the operation of a display of the PC.

In one aspect of the present invention, an off-screen portion of the VRAM is designated for use as a virtual VGA video buffer. The CPU is permitted to read and write VGA style memory to the virtual VGA video buffer through a 64 KB portion of the traditional 128 KB VGA aperture comprising CPU addresses A0000-BFFFFh. The remaining 64 KB portion, as well as conventional 1 MB and 4 MB XGA apertures, are used to access XGA video memory, which comprises the remainder of the VRAM above the VGA virtual video buffer. The start addresses of each of the 64 KB VGA aperture and the 64 KB, 1 MB and 4 MB XGA apertures are stored in four registers, respectively, within the host interface.

In another aspect of the present invention, when the display adapter is operating in native mode with virtual VGA enabled, during each VRAM access, comprising a request from the CPU for a read and/or write operation to be performed on the VRAM, logic circuitry of the host interface compares the address generated by the CPU is compared with the start addresses stored in each of the four registers to determine whether the memory access is an XGA native mode access or a virtual VGA access. If it is determined that the access is a virtual VGA access, the CPU address, as well as any associated pixel data to be written to VRAM at that address, are routed to the VGA graphics assist hardware, which processes the address and/or data before outputting them to the memory controller. In particular, the CPU address is remapped such that the requested read/write operation is performed on the virtual VGA memory buffer portion of the VRAM. If the access is determined to be an XGA native mode access, the CPU address and/or data is routed directly to the memory controller.

In yet another aspect of the present invention, the XGA display adapter includes a conventional XGA Operating Mode register. One bit of this register, which has not heretofore been used as a control bit, is designated as a "Virtual VGA Enable" (VVE) bit. The VVE bit, in conjunction with two other control bits of the XGA Operating Mode register, which are a VGA Enable bit and a Display Mode bit, may be set by applications software selectively to enable the virtual VGA function of the present invention such that virtualization of VGA graphics modes may be supported during XGA native mode.

A technical advantage achieved with the invention is that it enables the virtualization of VGA graphics modes during XGA native mode by making the VGA graphics assist hardware and certain VGA registers accessible during native mode operation.

A further technical advantage achieved with the invention is that it allows for virtualization of VGA graphics modes without requiring a separate VGA module to be included in the XGA adapter by using VGA hardware conventionally included in XGA adapters for performing VGA graphics assist functions when the XGA is operating in VGA mode.

BRIEF DESCRIPTION OF THE DRAWINGS

FIG. 5 is a memory map of a video random access memory (VRAM) of the PC of FIG. 1.

FIG. 6 is a table of VGA register bits available when XGA is in native mode and virtual VGA is enabled in accordance with the present invention.

DESCRIPTION OF THE ILLUSTRATIVE EMBODIMENTS

Figure 1:
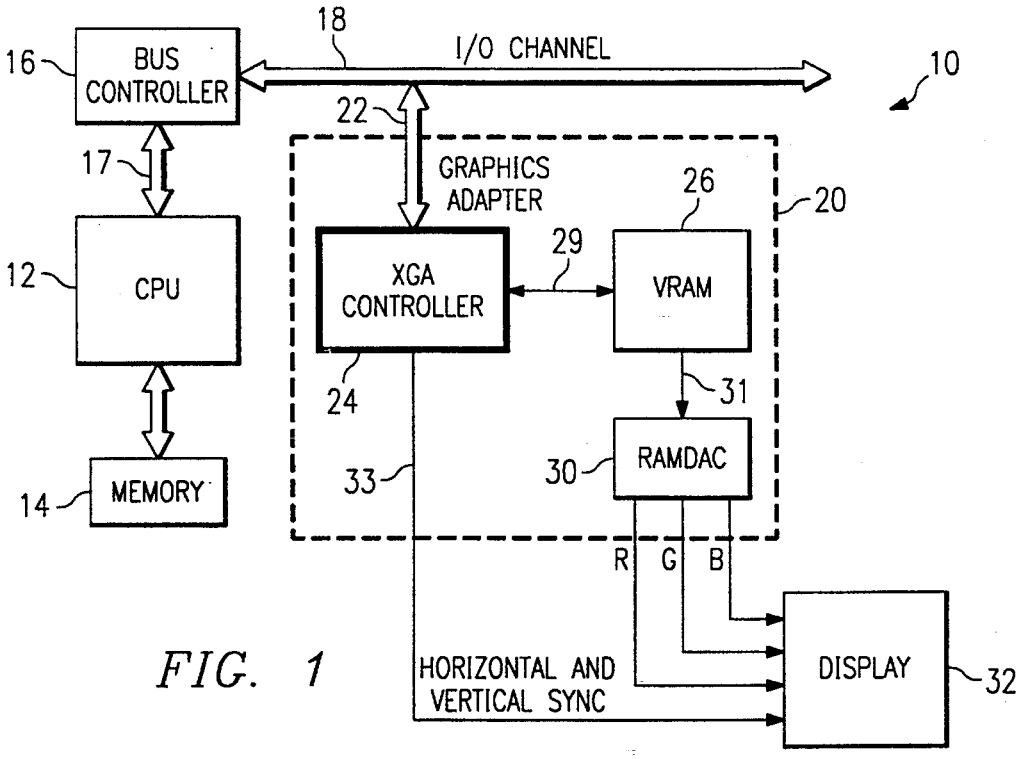
FIG. 1 is a schematic block diagram of a personal computer (PC) embodying features of the present invention.

Referring to FIG. 1, the reference numeral 10 designates a personal computer (PC) embodying features of the present invention. The PC 10 comprises a CPU 12 and associated memory 14 and a bus controller 16 for interfacing a CPU local bus 17 with an I/O channel 18. An XGA display adapter 20 is also connected to the I/O channel 18 via a bidirectional bus 22.

The display adapter 20 comprises an XGA controller 24 interfacing with a frame buffer, which in the preferred embodiment is a video random access memory (VRAM) 26, via a line 29. Digital pixel data stored in the VRAM 26 is output to a RAMDAC 30 via a line 31. The RAMDAC 30 formats the digital data and converts it to analog red, green and blue signals, which are output on lines R, G and B, respectively, to drive a display 32. The display 32 may comprise, for example, a conventional cathode ray tube (CRT) monitor. Horizontal and vertical synchronization (sync) timing signals for controlling the scan rate of the display 32 and other control signals generated by the XGA controller 24 are provided to the display 32 via a line 33.

It should be understood-that, with the exception of the XGA controller 24, which will be described in further detail with reference to FIG. 2, the components shown in FIG. 1 are conventional computer components, the function and operation of which are well known in the art and will therefore not be further described herein.

Figure 2:
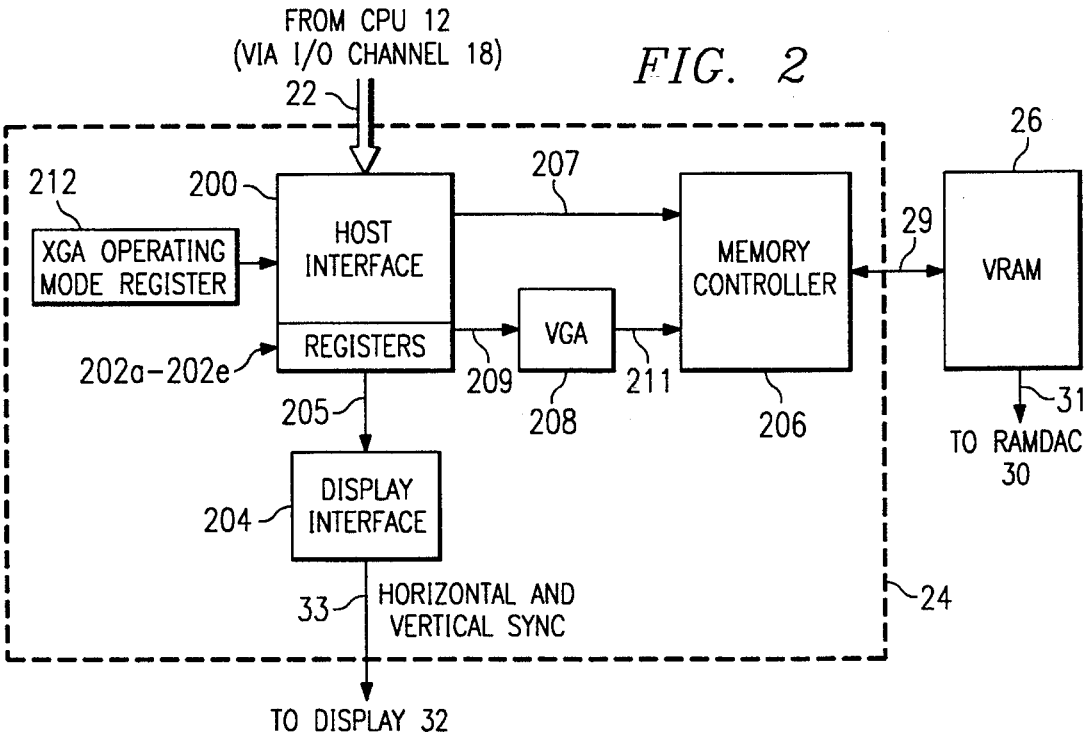
FIG. 2 is a schematic block diagram of an extended graphics array (XGA) controller of the PC of FIG. 1.

FIG. 2 is a more detailed schematic block diagram of the XGA controller 24 of FIG. 1. The XGA controller 24 comprises a host interface 200 for interfacing the XGA controller 24 with the I/O channel 18. Included within the host interface 200 are a number of registers 202*a*–202*e*, the values of which are initialized by applications software, as will be described. The host interface 200 is connected to a display interface 204 via a line 205 for providing appropriate timing and other control signals thereto. The display interface 204 is responsible for generating the vertical and horizontal sync signals and other control signals to the display 32 via the line 33.

The host interface 200 is further connected to a memory controller 206 via a line 207 and to VGA graphics assist hardware 208 via a line 209. The graphics assist hardware 208 is also connected to the memory controller 206 via a line 211. The graphics assist hardware 208 comprises VGA hardware that is conventionally included within XGA display adapters, such as the adapter 20, for performing VGA graphics assist functions with respect to VRAM 26 accesses when the adapter 20 is operating in its VGA, rather than native, mode. Therefore, the graphics assist hardware 208 is capable of performing functions related to exploiting the planar format of the VRAM 26 during VGA graphics modes, as well as other operations, such as data rotate, color expansion, color compare, bit masking. It should be understood that, although illustrated as a single component, the functions performed by the hardware 208 may be distributed throughout the other components of the adapter 20. The memory controller 206 is connected to the VRAM 26 via the line 29 for providing an interface between the VRAM 26 and the CPU 12 and for performing data reads and writes from and to the VRAM 26 during VRAM 26 accesses.

During each VRAM 26 access, which will comprise a request from the CPU 12 for a particular read or write operation to be performed on the VRAM 26, an address output by the CPU 12 and any data to be written to the VRAM 26 are input to the host interface 200, via the I/O channel 18 and the bus 22. As will be described, in greater detail with reference to Table I below when a virtual VGA function of the present invention is enabled, as indicated by the state of certain bits in an XGA Operating Mode register 212 the host interface 200 will route the CPU address and/or associated data either directly to the memory controller 206 via the line 207 or to the VGA graphics assist hardware 208 via the line 209, depending on whether the CPU address corresponds to a native (XGA) memory access or to a virtual VGA memory access, respectively.

Figure 3:
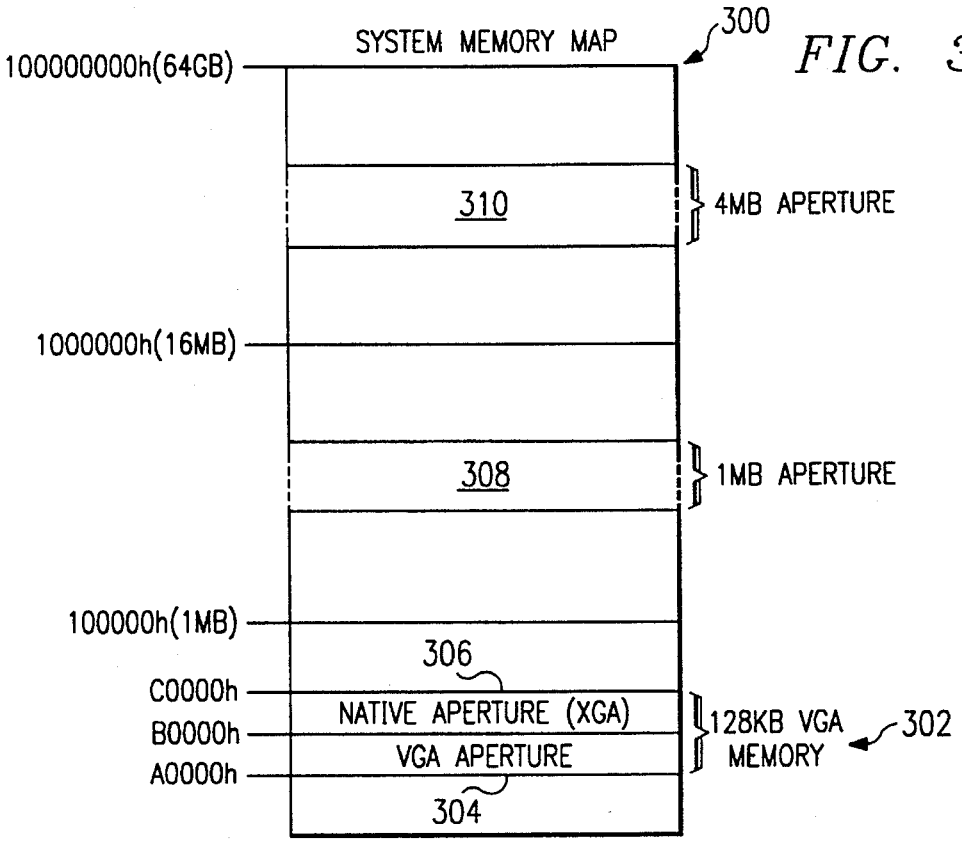
FIG. 3 is a memory map of the PC of FIG. 1.

FIG. 3 is a system memory map 300 of the PC 10. It should be understood that the memory map 300 is not drawn to scale. A 128 KB aperture 302, defined by a range of addresses from A0000h to BFFFFh, represents the traditional VGA address space for accessing up to 256 KB of VGA memory. In other words, memory accesses to CPU addresses within this aperture 302 are conventionally interpreted as VGA memory accesses.

XGA supports three different addressing schemes, or apertures, the accessibility and use of which is dependent on the type of processor used to implement the CPU 12 and the bus width of the slot into which the adapter 20 is plugged. The most basic scheme, used by 8086 and 8088 processors, employs a 64 KB aperture located within the traditional VGA aperture 302 and defined by a range of addresses extending from A0000h to AFFFFh or from B0000h to BFFFFh.

As will be described, in a preferred embodiment, the lower 64 KB section 304 of the 128 KB aperture 302, i.e., addresses A0000h through AFFFFh, may be designated for use as the VGA aperture, while the upper 64 KB section 306 of the aperture 302, i.e., addresses B0000h through BFFFFh, may designated as the 64 KB XGA native aperture. The locations of these apertures 302, 304 are defined in registers 202*a* and 202*b*, respectively. Because, as previously indicated, these registers 202*a*, 202*b* are set by software, the designations may be reversed, if desired, such that the 64 KB section 304 functions as the XGA native aperture and the 64 KB section 306 functions as the VGA aperture.

80286 and 80386SX processors can also address XGA memory through a 1 MB aperture 308, the location of which is defined in register 202*c*. The 1 MB aperture 308 may be located on any 1 MB boundary within the first 16 MB of extended memory and is paged to allow access to all 4 MB of XGA memory within the VRAM 26.

Finally, 80386DX, 80486 and other processors that utilize a 32-bit wide address bus can address XGA memory through a 4 MB aperture 310, the location of which is defined in register 202*d*. The 4 MB aperture 310 will be located in extended memory above the first 16 MB, thereby allowing a direct, rather than paged, access to the 4 KB of XGA memory of the VRAM 26.

Figure 4:
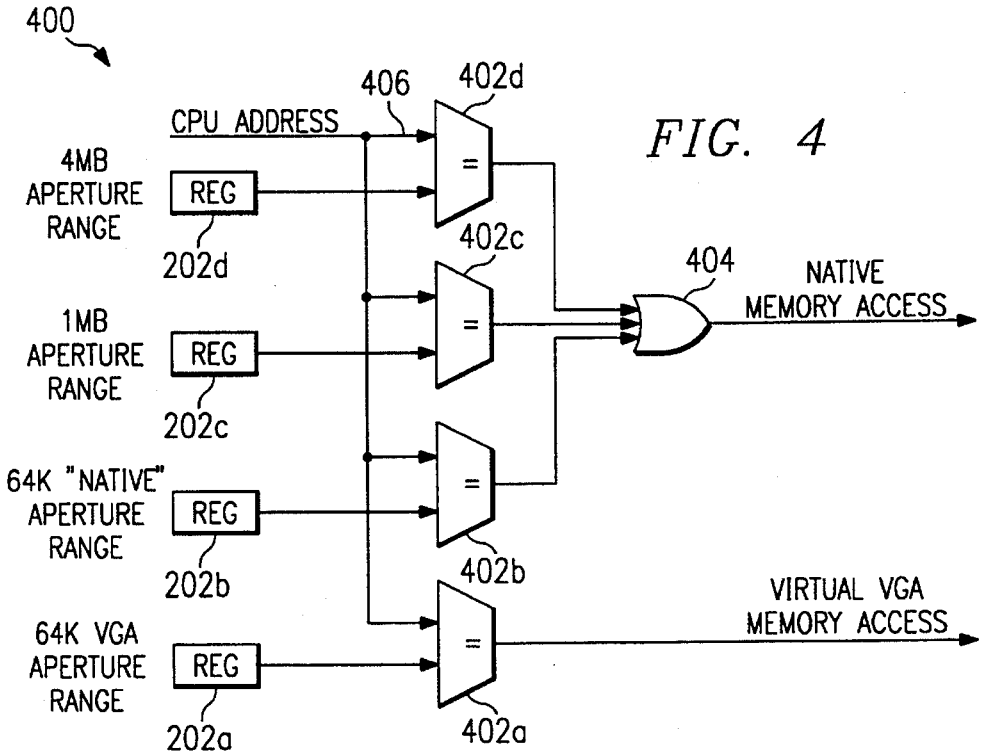
FIG. 4 is a schematic diagram of a logical comparator circuit of the XGA controller of FIG. 2 for enabling access to VGA graphics assist hardware.

FIG. 4 illustrates a logic circuit 400, which is embodied within the host interface 200. When the virtual VGA function of the present invention is enabled, as described below, with respect to each VRAM 26 access, the circuit 400 is used to determine whether the access is a virtual VGA memory access or a native memory access and to route the access (i.e., the CPU address and any data to be written to the VRAM 26) accordingly.

The logic circuit 400 comprises four comparators 402*a*–402*d*, respectively, each having one input connected to receive an address output by the CPU 12 on the I/O channel 18 during a VRAM 26 access. The other input of each of the comparators 402*a*–402*d* is connected to receive the address stored in one of the registers 202*a*–202*d*, respectively. The outputs of the comparators 402*b*–402*d* are input to an OR gate 404, the output of which comprises a "Native Memory Access" signal for indicating that the VRAM 26 access is to be processed as a native memory access. Similarly, the output of the comparator 402*a* comprises a "Virtual VGA Memory Access" signal for indicating that the VRAM 26 access is to be processed as a virtual VGA access.

In operation, during each VRAM 26 access, the CPU address and any data to be written to the VRAM 26 is input to the host interface 200 of the XGA controller 24, as would typically be the case. However, when the virtual VGA function is enabled, the CPU address is input to each of the comparators 402*a*–402*d* via a line 406, which comparators compare the CPU address with the values stored in the registers 202*a*–202*d*, respectively. Specifically, the comparator 402*a* compares the CPU address on line 406 with address of the 64 KB VGA aperture and if the CPU address falls within the VGA aperture address range, the Virtual VGA Memory Access signal is driven active high, indicating a virtual VGA memory access. Responsive to the active Virtual VGA Memory Access signal, the host interface 200 routes the CPU address and/or data: to the graphics assist hardware 208 via the line 209. The graphics assist hardware performs the appropriate VGA graphics assist functions and then routes the address and/or data to the memory controller, which performs the requested operation on the VRAM 26. In particular, the graphics assist hardware 208 remaps the CPU address such that the requested operation is performed on an off-screen portion of the VRAM 26, designated as a virtual VGA memory buffer (FIG. 5).

Similarly, the comparators 402*b*–402*d* compare the CPU address on line 406 with the addresses of the 64 MB XGA native aperture 306, the 1 MB aperture 308 and the 4 MB aperture 310, respectively, stored in the registers 202*b*–202*d*, respectively. If the CPU address falls within the address range of one of the apertures 306, 308 or 310, the output of the corresponding comparator 402*b*, 402*c* or 402*d* will driven active high, which in turn drives the output of the OR gate 402 high, activating the Native Mode Memory Access signal. In this case, the host interface 200 routes the CPU address and any data to be written to the VRAM 26 directly to the memory controller 26 via the line 207. In this case, the operation is performed on an on-screen portion of the VRAM 26, designated as an XGA native mode frame buffer (FIG. 5).

As previously indicated, a particular object of the present invention is to permit the VGA graphics assist hardware 208 to be accessed during XGA native mode to enable support of virtual VGA graphics modes in windowing environments during XGA native mode. To this end, it is well known that the adapter 20 includes an XGA Operating Mode register 212 (FIG. 2), the purpose of which is to control the mode of operation of the display adapter 20. Typically, the mode of operation will be set by two control bits of this register, which are a VGA Enable bit and a Display Enable bit, which enable operation in VGA mode or in XGA native mode without VGA virtualization, depending on the state of the bits.

However, in accordance with a feature of the present invention, an additional bit of the XGA Operating Mode register 212 (FIG. 2), designated as the Virtual VGA Enable (VVE) bit, is used in combination with the VGA Enable and Display Enable bits to permit applications software selectively to enable or disable VGA virtualization in XGA native mode by setting these three bits as shown below in Table I:

TABLE I

| CONTROL BITS | | | |
|---|---|---|---|
| VVE | DISPLAY MODE | VGA ENABLE | MODE OF OPERATION |
| 0/1 | 0 | 0/1 | VGA Mode |
| 0 | 1 | 0/1 | Native Mode (no virtual VGA) |
| 1 | 1 | 0 | Native Mode (no virtual VGA) |
| 1 | 1 | 1 | Native Mode (no virtual VGA) |

Referring to Table I, it is easily recognized that when the Display Mode bit is set to zero, the mode of operation of the adapter 20 will be VGA mode, regardless of the values of the other two control bits. Similarly, when the Display Mode bit is set to one and the VVE bit is set to zero, or when the Display Mode and VVE bits are set to one and the VGA Enable bit is set to zero, the operating mode of the adapter 20 will be XGA native mode without virtual VGA. To enable the virtual VGA function of the present invention (i.e., to enable access to the graphics assist hardware 208 as described above with respect to FIG. 4) all of the control bits must be set to one. When this is the case, the mode of operation of the adapter 20 will be XGA native mode with virtual VGA enabled. This last mode of operation is the one introduced by the present invention.

FIG. 5 is a memory map 500 of the VRAM 26 from the perspective of the CPU 12 when the virtual VGA function of the present invention is enabled by setting the appropriate control bits of the XGA Operating Mode register 212 (FIG. 2) as described above. A virtual VGA memory buffer 502 begins at offset 0 of the VRAM 26 and extends up to XKB, which corresponds to the complete addressability of VGA memory will therefore be less than or equal to 256 KB, depending on the VGA graphics mode being virtualized. The virtual VGA memory buffer 502 is comprised completely of off-screen memory, meaning that images stored in the buffer 502, in the form of digital pixel data, are not displayed on the display 32.

An XGA native mode i frame buffer 504 extends from the XKB boundary through 4096 KB. The start address of the XGA native mode frame buffer 504 is stored in XGA Start Address registers 202*e*. As during virtualization of VGA in a VGA display system, the virtual VGA memory buffer 502 is allocated to various VGA-based applications being executed by the CPU 12 in multiples of 16 KB for their use as a virtual video buffer. The buffer 502 is allocated in 16 KB blocks due to the 4 KB granularity of the virtual memory mechanism and to the fact that in planar graphics modes, 4 KB of VGA address space actually represents 16 KB of VRAM 26.

A virtual VGA device driver (not shown) of an operating system of the PC 10 will map each VGA-based application's video buffer to its virtual video buffer within the virtual VGA memory buffer 302. VGA registers (FIG. 6) are loaded with values provided by a VGA-based application and that application is allowed freely to read and write its virtual video buffer via the VGA graphics assist hardware 208 and the memory controller 206. Periodically, the operating system will convert the contents of the application's virtual video buffer from a VGA format to the XGA format of the display 32 and then render the contents on the display 32 in the appropriate window.

FIG. 6 is a table of VGA register bits which may be written when the virtual VGA function of the present invention is enabled. Although not shown, it should be understood that the registers listed in the table of FIG. 6, which registers are well known to those skilled in the art of computer programming, are preferably embodied in the VGA graphics assist hardware 208. It should be noted that bit 1 of the Miscellaneous Output Register, which is designated as the Enable RAM bit, is assumed to be set to 1 (VGA memory decodes enabled) during virtual VGA operation. It should further be noted that bits other than those listed in the table of FIG. 6 are not writable and will return undefined data on reads.

In a preferred embodiment, the virtual VGA function herein described must be explicitly enabled by an application's setting the appropriate control bits of the XGA Operating Mode register 212 (FIG. 2). In other words, the "default" operating mode of the display adapter 20 will not be XGA native mode with virtual VGA enabled. This prevents XGA-based applications that use a portion of the 128 KB VGA aperture for XGA native memory accesses from crashing. Hence, only those applications which are "aware" of the virtual VGA function supported by the present invention may enable and use the function.

It should be understood that when XGA is in native mode and virtual VGA is enabled, the A0000h through BFFFFh memory address range becomes the virtual VGA memory space, although the memory address range depends on the Memory Map bits in the VGA Miscellaneous Register. Accesses to the native memory buffer are preferably performed through the 1 MB aperture 308 and/or the 4 MB aperture 310, although, as described above, the 64 KB aperture 306 may also be used, so long as an appropriate device driver prevents conflicts with the VGA aperture 304.

It is understood that the present invention can take many forms and embodiments. The embodiments shown herein are intended to illustrate rather than to limit the invention, it being appreciated that variations may be made without departing from the spirit of the scope of the invention. For example, although the graphics assist hardware is illustrated as a single, discrete module 208, it should be understood that this need not be the case and that the VGA graphics assist functions performed thereby may be distributed among the remaining components of the controller 20. Furthermore, it will be appreciated that different elements may be embodied as a single integrated chip, or any varying combination of discrete digital or analog components interconnected in a standard manner.

Although illustrative embodiments of the invention have been shown and described, a wide range of modification, change and substitution is intended in the foregoing disclosure and in some instances some features of the present invention may be employed without a corresponding use of the other features. Accordingly, it is appropriate that the appended claims be construed broadly and in a manner consistent with the scope of the invention.

What is claimed is:

1. An extended graphics array (XGA) controller for a computer display subsystem for selectively enabling support of virtual video graphics array (VGA) graphics modes during XGA native mode operation of said display subsystem, the XGA controller comprising:

a memory controller having an output electrically coupled to an input of a video memory for performing read or write operations on said video memory in response to requests by a central processing unit (CPU), said video memory comprising an XGA memory portion and a VGA memory portion;

VGA graphics assist hardware having an output electrically coupled to an input of said memory controller; and a host interface having an input electrically connected to said CPU for receiving said CPU requests, a first output electrically connected to said memory controller and a second output electrically connected to said VGA graphics assist hardware, said host interface comprising circuitry for determining whether each of said CPU requests comprises a request for an XGA memory operation or a request for a VGA memory operation and for routing XGA memory operation requests directly to said memory controller and VGA memory operation requests to said memory controller via said VGA graphics assist hardware;

wherein said VGA graphics assist hardware comprises circuitry for performing VGA graphics assist functions on an address and data of each of said VGA memory operation requests.

2. The controller of claim 1 wherein said XGA memory portion is addressable through at least one XGA aperture and said VGA memory portion is addressable through a VGA aperture, said XGA controller further comprising first and second storage means electrically coupled to said host interface circuitry for storing a value indicative of a range of addresses defining said at least one XGA aperture and a value indicative of a range of addresses defining said VGA aperture, respectively.

3. The controller of claim 2 wherein said host interface circuitry comprises:

a first comparator having a first input connected to said first storage means and a second input connected to receive CPU addresses of said CPU requests for comparing said CPU addresses with said range of XGA aperture addresses;

a second comparator having a first input connected to said second storage means and a second input connected to receive said CPU addresses for comparing said CPU addresses with said range of VGA aperture addresses;

wherein, with respect to each of said CPU requests, said host interface circuitry outputs a first signal indicative of an XGA memory operation request when said CPU address of said CPU request falls within said at least one XGA memory aperture and a second signal indicative of a VGA memory operation request said CPU address of said CPU request falls within said VGA memory-aperture.

4. The controller of claim 1 further comprising means for storing a start address of said XGA memory portion.

5. The controller of claim 1 wherein said VGA memory portion comprises off-screen video memory.

6. The controller of claim 1, wherein a device driver periodically converts data stored in said VGA memory portion from a VGA pixel format to an XGA pixel format and copies said reformatted data to said XGA memory portion for display on a display screen of said display subsystem.

7. The controller of claim 1 further comprising an XGA Operating Mode register having at least one writable control bit for controlling a mode of operation of said display subsystem.

8. The controller of claim 1 wherein said VGA memory portion is allocated in sixteen kilobyte blocks of memory to at least one VGA-based application being executed by said CPU for use by at least one VGA-based application as a virtual video buffer.

9. Apparatus for enabling VGA graphics mode virtualization during native mode operation of a display adapter, the apparatus comprising:

means for generating a request for an operation to be performed on a video memory means of said display adapter, said video memory comprising a native memory portion and a virtual VGA memory buffer portion;

means connected to receive said request from said generating means for comparing an address of said request with a range of addresses defining a first aperture through which said native memory portion is addressable and with a range of addresses defining a second aperture through which said virtual VGA memory buffer portion is addressable;

means for generating a first signal if said request address falls within said first memory aperture address range and a second signal if said request address falls within said second memory aperture address range;

controller means connected to said comparing means for performing read and write operations on said video memory means;

graphics assist means connected between said comparing means and said controller means for performing graphics assist functions on an address and data of each request input thereto;

means responsive to said first signal for routing said request directly to said controller means, said controller performing said requested operation on said native memory portion; and means responsive to said second signal for routing said request to said controller means via said graphics assist means, said controller means performing said requested operation on said virtual VGA memory buffer portion.

10. The apparatus of claim 9 further comprising first and second means connected to said comparing means for storing a value indicative of said first memory aperture address range and a value indicative of said second memory aperture address range, respectively.

11. The apparatus of claim 9 wherein said virtual VGA memory buffer portion comprises off-screen memory and is allocated in blocks of sixteen kilobytes to at least one VGA-based application for use thereby as a virtual video buffer.

12. The apparatus of claim 9 further comprising device driver means for periodically converting data stored in said virtual VGA memory buffer portion from a VGA pixel data format to a native mode pixel data format and copying said converted data to said native memory portion for display.

13. The apparatus of claim 9 further comprising means for storing a start address of said native memory portion of said video memory.

14. The apparatus of claim 9 further comprising means for setting a mode of operation of said display adapter.

15. A method of virtualizing VGA graphics modes during XGA native mode operation of a display adapter, the method comprising:

generating a request for a read or write operation to be performed on a video memory of said display adapter;

comparing an address of said request with a range of addresses defining an XGA aperture through which an XGA memory portion of said video memory is addressable;

comparing said request address with a range of addresses defining a VGA aperture through which a virtual VGA memory buffer of said video memory is addressable;

responsive to said request address failing within said XGA aperture address range, performing said requested operation on said XGA memory portion; and responsive to said associated address falling within said VGA aperture address range, performing said requested operation on said virtual VGA memory buffer.

16. The method of claim 15 wherein said performing said requested operation on said XGA memory portion comprises:

routing said request to a memory controller connected to said video memory; and using said memory controller to perform said requested operation on said XGA memory portion.

17. The method of claim 15 wherein said performing said requested operation on said virtual VGA memory buffer comprises:

routing said request to VGA graphics assist hardware;

using said VGA graphics assist hardware to perform VGA graphics assist functions on an address and data of said request;

after said graphics assist functions have been performed, forwarding said request to a memory controller connected to said video memory; and using said memory controller to perform said video memory operation on said virtual VGA memory buffer.

18. The method of claim 15 further comprising:

storing a value indicative Of said XGA aperture address range in a first register; and storing a value indicative of said VGA aperture address range in a second register.

19. The method of claim 15 further comprising storing a start address of said XGA memory portion in a register.

20. The method of claim 15 further comprising setting at least one control bit in an XGA Operating Mode register to enable said VGA graphics mode virtualization.

21. The method of claim 15 wherein said virtual VGA memory buffer comprises off-screen video memory, the method further comprising allocating said virtual VGA memory buffer to at least one VGA-based application in blocks of sixteen kilobytes for use by said at least one VGA-based application as a virtual memory buffer.

* * * * *